United States Patent [19]

Canfield et al.

[11] Patent Number: 4,823,529

[45] Date of Patent: Apr. 25, 1989

[54] DECK CONSTRUCTION

[76] Inventors: Ronald P. Canfield; Richard C. Hagel, both of 1124 Bennett Clark Rd., Nacogdoches, Tex. 75963

[21] Appl. No.: 26,944

[22] Filed: Mar. 17, 1987

[51] Int. Cl.[4] ..... E04B 1/00

[52] U.S. Cl. ..... 52/263; 52/299; 52/79.6; 52/712

[58] Field of Search ..... 52/263, 299, 79.6, 712, 52/715, 301

[56] References Cited

U.S. PATENT DOCUMENTS

| | | | |
|---|---|---|---|
| 710,538 | 10/1902 | Summerer et al. | 52/301 X |
| 2,037,736 | 4/1936 | Payne et al. | 403/187 X |
| 2,818,947 | 1/1958 | Goldberg | 52/715 X |
| 2,966,708 | 1/1961 | Freeman, Jr. | 403/230 X |
| 3,195,694 | 7/1965 | De Castro | 52/299 X |
| 3,416,282 | 12/1968 | Daugherty | 52/823 X |
| 3,785,110 | 1/1974 | Galloway et al. | 52/715 |
| 4,242,844 | 1/1981 | Schoultz | 52/823 X |
| 4,622,792 | 11/1986 | Betts | 52/263 |
| 4,691,484 | 9/1987 | Wilson | 52/79.6 |

*Primary Examiner*—Carl D. Friedman

[57] ABSTRACT

A modular deck construction characterized by having one or more prefabricated floor panels with prefabricated stair parts, i.e., treads and side runners, together with prefabricated banisters and side railing members. The deck frame and other parts are pre-drilled as necessary to provide a fail-safe arrangement for mounting the stairs, banisters, and side rails with the floor panel such that the stair may be positioned on either side or either end of the floor deck. The modular system facilitates assembling a deck of any number of the prefabricated floor panels. The invention also includes connecting means for joining interior corners of adjacent floor panels and supporting them in an elevated position above ground level.

6 Claims, 3 Drawing Sheets

DECK CONSTRUCTION

BACKGROUND OF THE INVENTION

For years outdoor decking has been a desirable feature for use either freestanding or joined to a housing structure such as a conventional dwelling of brick, lumber, siding, or other exterior surface material, or with mobile homes and the like. Various lumber yards and home supply stores have made available pre-cut flooring material, stair treads, and banisters for assembly on site by a carpenter or other craftsman, however, these pre-cut boards solved only a part of the problem of erecting a deck and left a great deal of the detail work to be done on site by a skilled carpenter.

Even with the pre-cut pieces available heretofore, substantial cutting and fitting was necessary to make a finished deck and as a result of field versus shop cuts, the pieces were often not of uniform size and squareness required to produce a first-class finished deck when done by workman of less than consummate skill and carefulness.

An object of the present invention is to provide a modular deck having all components pre-cut and some pre-assembled and also having the necessary holes for lag bolts or screws pre-drilled to facilitate correct assembly of the various components with the prefabricated floor section without the critical measuring and placement of the connecting holes left to the assembler. This way, a person with less than craftsman skills can produce a deck which is symmetrical and which, when finished, has the appearance of being constructed by professionals. A further object of this invention is to provide a modular deck with floor sections which may be joined together to provide a deck of any number of several sizes. It is also an object of this invention to provide a connecting member for joining adjacent interior corners of the various floor sections to quickly and easily secure them together in proper alignment and to provide a means for securing a vertical support member beneath the interior corners of the deck.

SUMMARY

The present invention includes a modular deck system which includes a central substantially horizontal floor section positioned above a grade by a plurality of legs which extend above the floor level to provide supports for a railing around the perimeter of the floor and a stairway and banister assembly providing access to and from the floor from ground level. Various components and parts are pre-cut and pre-drilled to facilitate erection and means are provided to connect adjacent interior corners of the floor together when a deck having at least four floor panels with abutting corners is erected.

DESCRIPTION OF THE PREFERRED EMBODIMENTS

Figure 7:
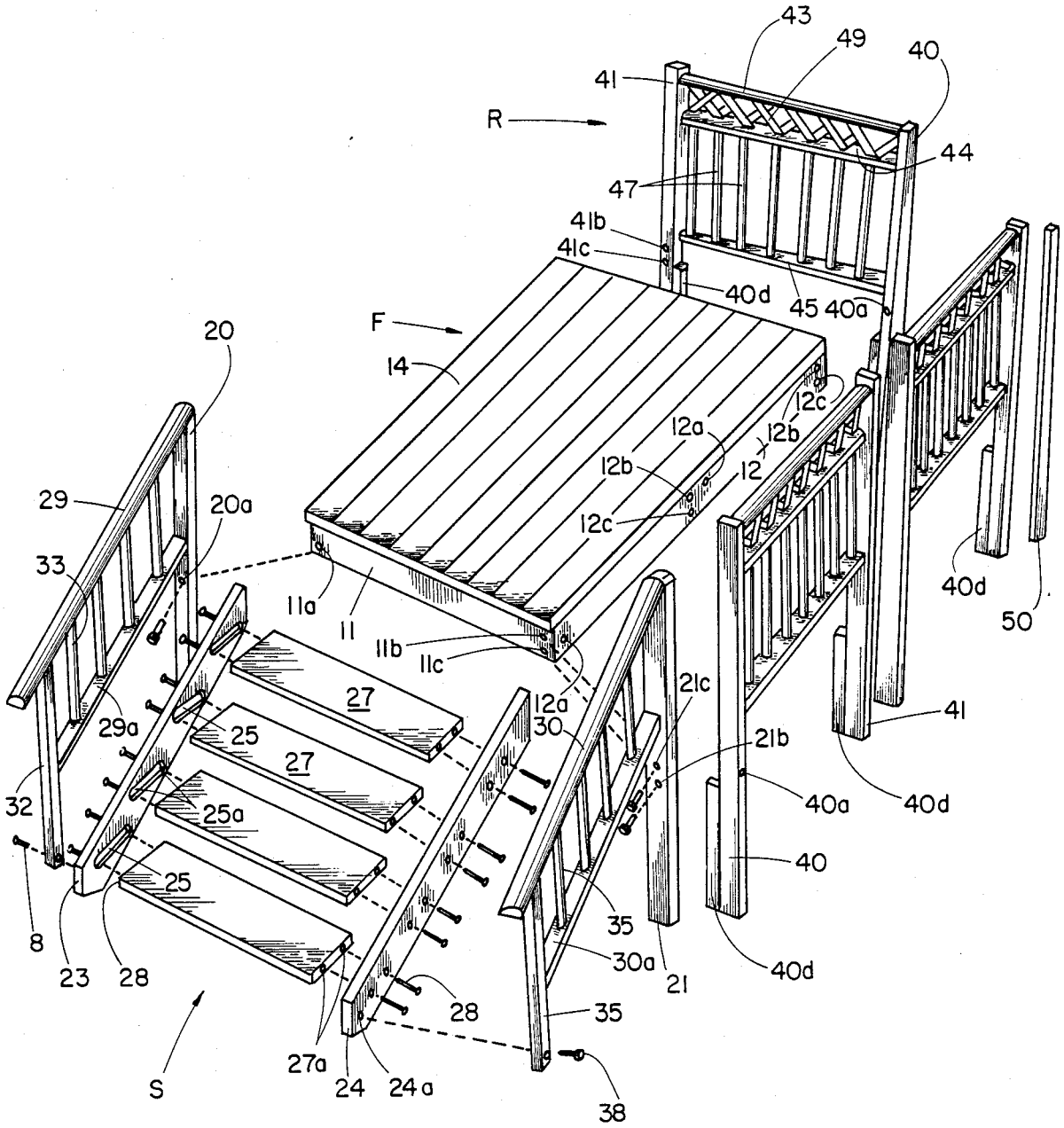
FIG. 7 is an isometric exploded view of the deck assembly including side rails and stairs and banisters.

Shown in FIG. 7 of the drawings are the basic components of the deck structure of the present invention which include the floor designated generally F, the side railings, designated generally R, and the stair designated generally S. The floor section F is generally rectangular and includes perimeter beam members 11 and 12 which are shown as well as corresponding perimeter members which are not shown but which are on the opposite end and opposite side of the rectangle from the members 11 and 12.

The floorboards 14 are secured to the perimeter members by nails or other securing means and the four corners formed by the perimeter members are also secured together by nails or screws to form a rigid floor section which is preferably of a standard size such as four feet by eight feet. Any number of these basic floor sections may be joined together to form a deck of any desired size or configuration in which the four by eight abutting sections may be arranged.

The perimeter members 11 and 12 are provided with pre-drilled holes 11*a*, 11*b*, and 11*c*, which are formed near the outer ends of the perimeter member 11 and its opposite counterpart at the other end of the floor section F. The single hole 11*a* on the left is spaced laterally apart from the vertically spaced pair of holes 11*b* and 11*c* a standard width to receive either the stair assembly S or a railing assembly R, as desired, which allows interchangeability of the stair and railing sections to provide a free choice of the location of a stair or railing at either end of the floor section F.

The side perimeter member 12 and its opposite counterpart also are provided with sets of pre-drilled holes comprising a single hole 12*a* and a pair of vertically spaced holes 12*b* and 12*c*. The single hole 12*a* is positioned on the left and is spaced laterally the standard distance from the vertically spaced pre-drilled holes 12*b* and 12*c* on the right extreme of the same standard spacing distance as the holes 11*a* are spaced from the pair of holes 11*b* and 11*c* and thus are arranged for receiving either a standard stair section S or a section of railing R. Similarly, the stair S has a left-hand banister support 20 which is provided with a single pre-drilled bolt hole 20*a* and a right vertical support member 21 which is provided with a vertically spaced pair of bolt holes 21*b* and 21*c*, which are located so as to be aligned with the holes 11*b* and 11*c* or, alternatively, the holes 12*b* and 12*c*. Thus the stair may be positioned on the side of the rectangular floor section F or at either end by aligning the single left banister support 20 with its support hole 20*a* over either single hole 12A and the perimeter side member 12 or with respect to the single hole 11*a* and the end member 11. Also, the right vertical banister support may have its spaced pair of holes 21*b* and 21*c* registered with the spaced pair of holes 12*b* and 12*c* respectively or the spaced pair of holes 11*b* and 11*c*.

Thus, it will be appreciated that the stair section S may be positioned at either end of the rectangular floor section F or at either of the two positions on each of the two longitudinal sides of such a rectangle.

Together with the vertical banister supports 20 and 21, are provided side runners 23 and 24 which have recessed slots 25 and their facing sides for receiving the ends of the stair treads 27. Spaced pairs of bolt holes 25*a* are provided in the recessed slots 25 and corresponding spaced holes 27*a* are provided in the ends of the stair treads 27 for receiving lag bolts 28 for securing the stair treads 27 in the slots 25 and the runners 23 and 24. The stairs are provided with a pair of hand rails or banisters 29 and 30. As shown in FIG. 7 of the drawings, the left banister is supported at its upper end by vertical support 20 and at its lower end by vertical support 32. A plurality of vertical rods or bars 33 are also provided which bars are substantially parallel to the vertical supports 20 and 32 and which extend downwardly from banister 29 to an intermediate support 29*a* which is generally parallel to the banister 29. Also, as shown in the drawings, the right banister 30 is supported at its upper end by vertical support 21 and at its lower end by vertical support 35. A plurality of vertical rods 36 extend downwardly from banister 30 to the intermediate support 30*a*. The lower ends of the vertical banister supports 32 and 35 are provided with pre-drilled bolt or lag screw holes 32*a* and 35*a*, respectively for receiving lag screws of bolt 38 which are received in pre-drilled holes such as 24*a* near the lower ends of the stair runners to 23 and 24.

In addition to the stair assembly S which may be located in any one of several positions provided by the pre-drilled holes in the floor section perimeter members, there are also provided a plurality of railing sections R that may be positioned in registry with the pre-drilled holes in the floor perimeter members to provide a continuous railing or banister structure around the full perimeter of the floor section, except for the stairway. The railing sections R comprise a pair of spaced vertical supports 40 and 41 with a generally horizontal upper member or handrail 43 and a pair of spaced horizontal members 44 and 45 there below. The lower horizontal member 45 is preferably spaced slightly above the upper level of the floor section F. Also there are included in the railing sections R and plurality of vertical bars 47 that extend between the intermediate an lower horizontal members 44 and 45, respectively. Also, a lattice work or diagonal members 49 may be provided between the upper handrail 43 and the intermediate horizontal member 44, if desired.

As shown in the drawings the left vertical support 40 of the railing section is provided with a single pre-drilled hole 40*a* adapted to be positioned in registry with one of the single holes 11*a* or 12*a* depending on where the railing section is positioned. Similarly, the other or right vertical support 41 is provided with a spaced pair of vertical holes 41*b* and 41*c* adapted to be registered relative to the vertical spaced holes 11*b* and 11*c* or 12*b* and 12*c*, as the case may be, depending upon the location of the railing section R relative to the floor section F. Each of the vertical supports 40 and 41 is provided with a knee piece 40*d*. This knee is bolted or otherwise secured to the vertical support 40 or 41 in its position with its upper end at an elevation such as to engage the lower edge of the floor perimeter members 12 and provide support for the floor section.

Figure 5:
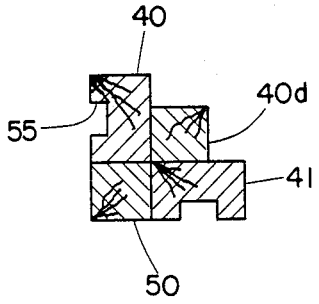
FIG. 5 is a cross sectional view taken on line 5—5 of FIG. 1.

Further, at each outside corner of the assembled deck section there is provided a vertical link 50 which is positioned abutting the inside corner of the two adjacent rail sections or a rail section and a stair section as the case may be. As shown in FIG. 5, when two vertical supports such as 40 and 41 shown in FIG. 1 are positioned adjacent to each other in a corner configuration the knee 40*d* is secured to both of the vertical supports with its upper end at an elevation such as to engage the lower edge of the floor perimeter member 12 and provide support for the floor section.

Figure 1:
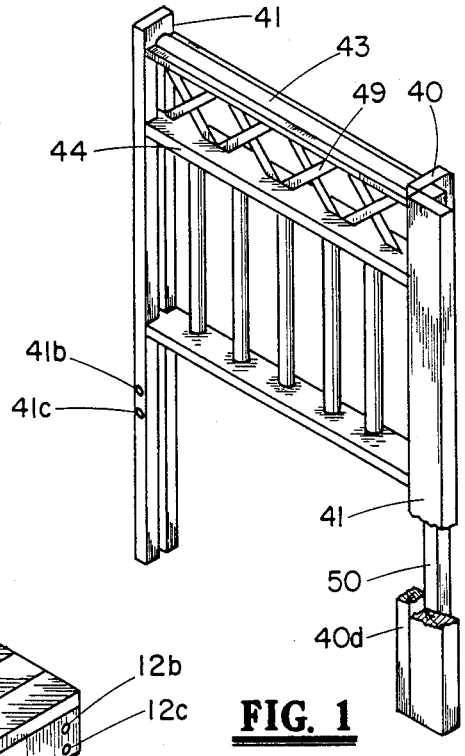
FIG. 1 is a partially exploded view of a side rail with support legs for supporting the deck above grade.
Figure 2:
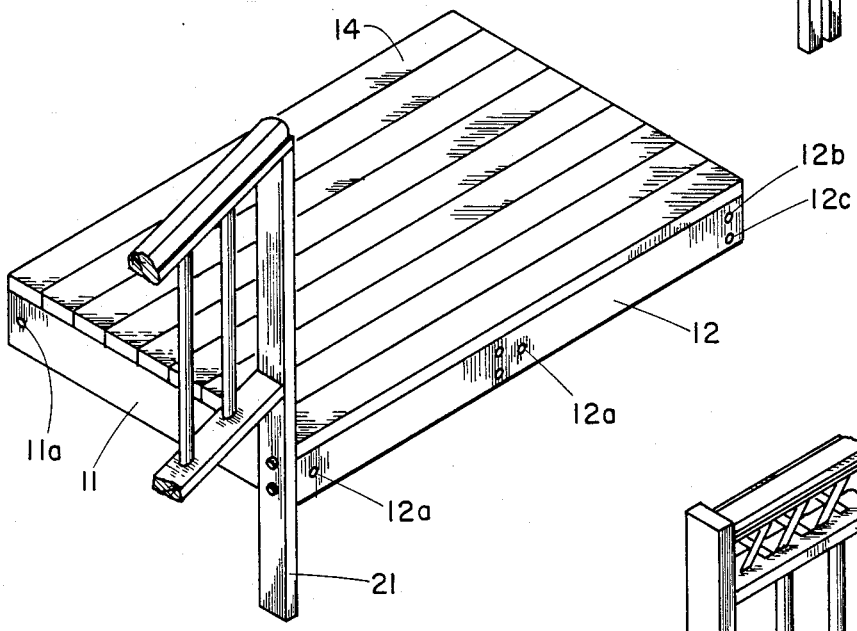
FIG. 2 is an isometric view of a floor section with a cutaway view of a stair banister.

Further, at each outside corner of the assembled deck section, such as illustrated in FIG. 5 and FIG. 1, there is provided a vertical link member 50 which is positioned abutting the inside corner formed by the two adjacent rail sections or a rail section and a stair section as the case may be. This link is secured to the two adjacent vertical supports by screws, bolts, or the like. It will be appreciated that with this type of structure in the corners, the modular deck section of the present invention is substantially strengthened and a relatively large cross sectional area of the combined assembled components of the two vertical supports 40 and 41 together with the knee 40*d* and the link 50.

Figure 3:
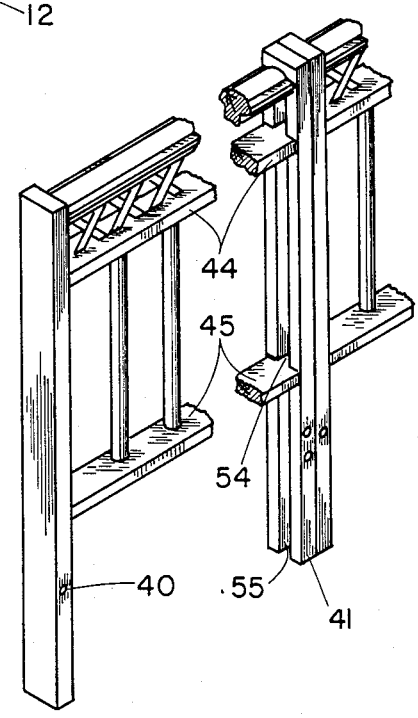
FIG. 3 is an isometric view partially cut away of a pair of sides abutting one another.
Figure 4:
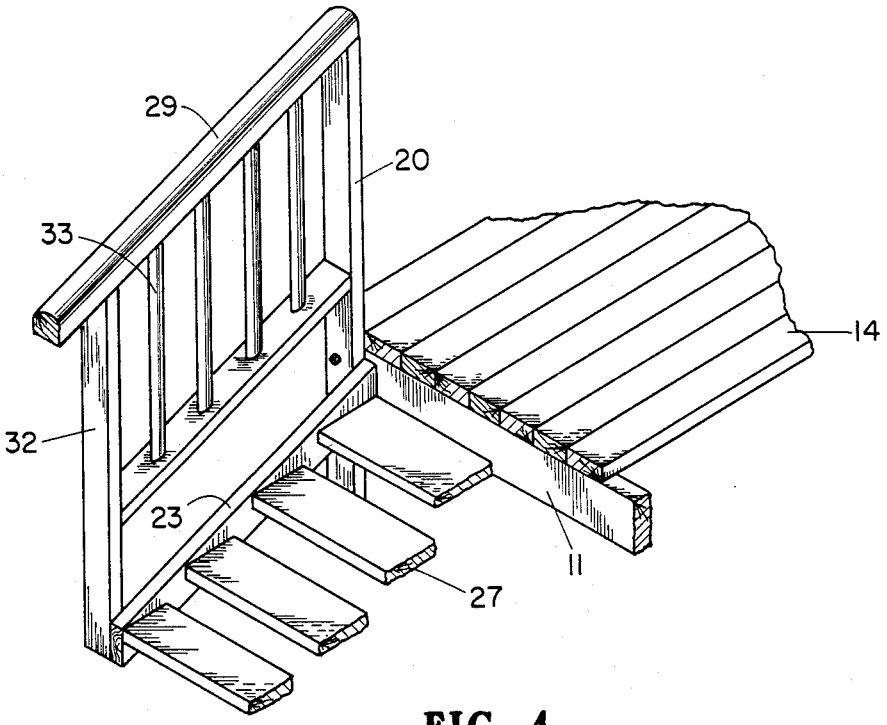
FIG. 4 is a partially cut away isometric view of the deck and a stair.

Also as shown in the drawings, FIG. 5, and FIGS. 1 and 3, the interior surfaces of the vertical legs 40 and 41, respectively are provided with longitudinal extending grooves 55 for receiving a projecting center end projection 56 of the horizontal lower and intermediate members 44 and 45 which provides a type of tongue in groove construction which substantially strengthens the assembled rail section R.

Figure 6:
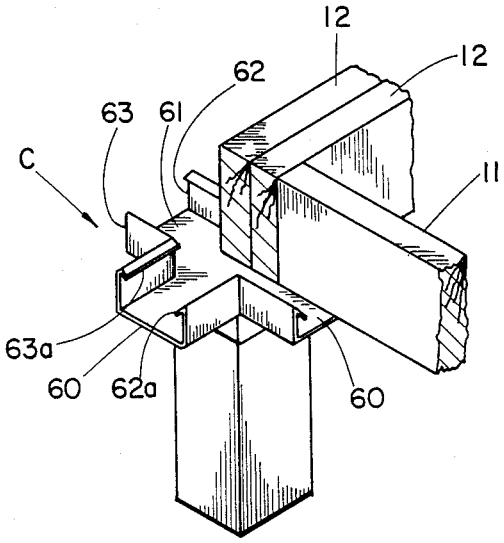
FIG. 6 is a partial isometric view of the means for connection adjacent floor section corners together.

As shown in FIG. 6 of the drawings, there is provided a cross-shaped connection member designated generally C which consists of four U-shaped troughs or channel members 60 disposed at 90° relative to one another and having a common bottom member 61. Each of the channels 60 is provided with a pair of upstanding sides 62 and 63 which extend at approximately 90° upwardly relatively to the bottom 61 and which terminate at their upper ends with downwardly and inwardly disposed connecting flanges or teeth which are provided for penetrating into the adjacent surfaces of the perimeter members 11 or 12 or to at least impose a strong compressive force thereon to rigidly hold such members together. As shown in the drawings, the bottom of each channel 60 is substantially the same width as the thickness of two adjacent perimeter members 12 or when the two are pressed tightly together in a side-by-side relationship. This is also true with respect to two of the end members 11 which are pressed closely together in a side-by-side relationship. When the floor panel sections are positioned in the channel connector C with the lower edges of such perimeter members 11 and 12 engaging the upper surface of the bottom 61 the flanges 62*a* and 63*a* are stressed by being bent downwardly by such floor section members and, depending upon the hardness of the wood forming the perimeter members 11 and 12, may penetrate the outer surface of such wood to hold such members firmly against relative movement. As shown, the channel connector C is positioned on a vertical support member 65 which may be either a four-by-four or other suitable size vertical support member that is preferably supported at grade level either on a concrete block (not shown) or may be positioned in a hole or depression in the ground surrounded by concrete or other suitable supporting material.

It will be appreciated that the modular deck construction of the present invention may be assembled by unskilled or semiskilled workers who can simply assemble the various parts in the desired arrangement and connect them together and to the deck or flooring by means of screws or lag bolts or the like put into position in the appropriate openings such as 11*a, b,* or *c,* and 12*a, b,* or *c,* and such other suitable openings as may be provided in the vertical support members such as 40*a* or 41*b* and *c*. Also, the vertical supports for the stair banisters may be positioned in the appropriate desired position relative to the floor simply by aligning or registering the predrilled holes 20*a* and 21*b* and c in the appropriate predrilled holes formed in the perimeter members 11 or 12, respectively. Also, it will be appreciated that any number of the rectangular floor sections F may be joined together to provide a deck of a desired configuration and, that the channel connector C may be provided in an alternative design in which a T shaped connector is provided for certain applications where for example two corners may abut a longitudinal perimeter member 12.

We claim:

1. A modular deck system comprising:

(a) a rectangular floor member having a perimeter support frame consisting of end and side members joined together at their adjacent ends and adapted to receive a floor, said side members being twice as long as said end members;

(b) a plurality of railing sections each as long as one of said end members and having a pair of laterally spaced vertical support members adapted to be secured to the end and/or the side members of said perimeter support frame, in a pre-determined position;

(c) a pair of upper and lower laterally spaced vertical support members for supporting stair runners and stair treads attached thereto;

(d) knee means on said vertical support members adapted to engage the lower side of said perimeter support members for supporting said support frame and said floor; and (e) means for positioning said vertical support member at either end of the rectangular floor member or in either of two pre-determined positions on either side of said rectangular floor member.

2. The invention of claim 1 wherein said means for positioning said vertical support members comprise:

pre-drilled laterally spaced holes in said end member and two pair of laterally spaced holes in said side members and side perimeter members for receiving connecting means to connect said pair of laterally spaced vertical rail support members or said pair of upper laterally spaced vertical stair runner support members to said perimeter frame at either end of said rectangular floor or at either of two positions on each of the two sides of such rectangular floor member.

3. The invention of claim 2 wherein said pre-drilled laterally spaced holes in said end and side perimeter members comprise a single hole near one end of said lateral space and a pair of vertically disposed holes near the other end of said lateral space and said lateral space is approximately the same as the length of one of said end members.

4. The invention of claim 2 wherein said laterally spaced pre-drilled holes include a single pre-drilled hole in one of said laterally spaced vertically rail support members and a pair of vertically disposed pre-drilled holes in the other of said laterally spaced vertical rail support members, said single hole said pair of vertically disposed holes adapted to be registered with said single hole and said pair of vertically disposed holes in said end or said side support member when said vertically spaced rail support members are connected thereto.

5. The invention of claim 2 including a single, pre-drilled hole in one of said upper laterally spaced vertical support members for supporting said stair runners and a vertically disposed pair of pre-drilled holes in the other of said upper laterally spaced vertical support member for supporting said stair runners, said single hole and said vertically disposed pair of holes adapted to be registered with said single hole in said pair of vertically disposed holes in said end or said side support members when said upper laterally spaced vertical support members for supporting said stair runners are connected to said end and said side members of said perimeter support frame.

6. The invention of claim 1 including linking means secured to adjacent sides of said vertical support members secured adjacent a corner of said perimeter support frame.

* * * * *